United States Patent [19]

Johnson et al.

[11] Patent Number: 4,986,099

[45] Date of Patent: Jan. 22, 1991

[54] LOCK SYSTEM AND LOCK HAVING TWO ELECTRONIC CONTROL SYSTEMS

[75] Inventors: Michael F. Johnson; Lyn M. Roberts, both of London; David E. Cooper, Surrey, all of England

[73] Assignee: Lynx Business Machines Limited, London, England

[21] Appl. No.: 443,877

[22] Filed: Nov. 30, 1989

Related U.S. Application Data

[63] Continuation of Ser. No. 199,388, May 27, 1988, abandoned.

[30] Foreign Application Priority Data

Jun. 1, 1987 [GB] United Kingdom ..... 8712805

[51] Int. Cl.[5] ..... E05B 49/02

[52] U.S. Cl. ..... 70/277; 70/166; 70/279; 70/280; 292/144; 340/825.56

[58] Field of Search ..... 70/DIG. 57, 163, 166, 70/DIG. 56, 281, 279, 280–283, 277; 340/825.56; 292/144, 341.16

[56] References Cited

U.S. PATENT DOCUMENTS

| | | | |
|---|---|---|---|
| 297,096 | 4/1884 | Woehrle | 292/341.16 |
| 297,751 | 4/1884 | Bunnell | 292/341.16 |
| 1,512,939 | 10/1924 | Ledin | 70/DIG. 57 X |
| 1,618,738 | 2/1927 | Weiss | 292/341.16 |
| 1,946,384 | 2/1934 | Baril et al. | 70/280 |
| 1,949,850 | 3/1934 | Willard | 292/341.16 |
| 3,768,284 | 10/1973 | Kent et al. | 70/104 |
| 3,881,171 | 4/1975 | Moorman et al. | 340/543 X |
| 4,209,782 | 6/1980 | Donath et al. | 70/278 X |
| 4,509,347 | 4/1985 | Young | 292/144 X |
| 4,534,194 | 8/1985 | Aydin | 70/278 |
| 4,615,548 | 10/1986 | McGee | 70/279 X |
| 4,633,688 | 1/1987 | Beudat et al. | 70/279 |

FOREIGN PATENT DOCUMENTS

| | | |
|---|---|---|
| 0021670 | 7/1984 | European Pat. Off. . |
| 1532702 | 11/1978 | United Kingdom . |
| 8403909 | 10/1984 | World Int. Prop. O. . |

*Primary Examiner*—Lloyd A. Gall

*Attorney, Agent, or Firm*—Hoffmann & Baron

[57] ABSTRACT

A lock (1) is mounted to a door (2) of a safe. The lock (1) comprises a housing (4) slidably mounted to the door (1) and movable in the directions indicated by an arrow (3) between locked and unlocked positions upon actuation of the lock. A lock override system (15) is coupled with the lock (1) and is responsive to an override control signal to cause the housing (4) to move relatively to the door and thereby to cause the lock member (8) to move between its locked and unlocked positions.

8 Claims, 4 Drawing Sheets

LOCK SYSTEM AND LOCK HAVING TWO ELECTRONIC CONTROL SYSTEMS

This is a continuation of copending application(s) Ser. No. 199,388, filed on May 27, 1988, now abandoned.

FIELD OF THE INVENTION

The invention relates to lock systems and locks, for example for use in locking doors to rooms, such as hotel rooms, and in locking doors to safes.

DESCRIPTION OF THE PRIOR ART

In the hotel field, it is common to provide a safe in each hotel room with a lock system having a lock and an associated control system for operating the lock when a valid code is entered into the control system. Typically, a guest can set the valid code by entering a suitable series of alphanumeric characters into a microcomputer of the control system which then only permits actuation of the lock when the same series of characters are subsequently reentered. In order to deal with a malfunction in the control system, a power failure, or failure of the guest to remember the code, it is usual to provide an override feature to enable the lock to be actuated by security personnel or the like. Typically, this override feature is provided by a mechanical key.

The override feature described above is undesirable since firstly the override key itself may be lost, copied, or fall into unauthorised hands, and secondly it is very difficult to change the override key.

SUMMARY OF THE INVENTION

In accordance with one aspect of the present invention, a lock system comprises a lock; a first control system associated with the lock to operate the lock when a valid code is entered into the control system; and a second control system independently connected to the lock and adapted to operate the lock independently of the first control system when an override code is entered into the second control system.

This invention deals with the problems mentioned above by providing two independent control systems each of which can operate the lock. Typically, an operator control panel of the first control system will be mounted in close physical proximity to the lock on the outside of a door or the like while an operator control panel of the second control system will be carried by security personnel and only connected to the second control system when it is necessary to implement the override feature.

In accordance with a second aspect of the present invention, a lock comprises a lock member mounted on a lock member support and movable relatively to the lock member support between locked and unlocked positions upon actuation of the lock; and lock override means coupled with the lock and responsive to override control signals to cause the lock member support to move relatively to a lock support member to which the lock is mounted in use and thereby to cause the lock member to move between its locked and unlocked positions.

This aspect of the invention provides a particularly simple way of achieving the override facility and is particularly suitable in combination with a lock system according with the first aspect of the invention in which the first control system effects normal operation of the lock while the second control system generates override control signals.

Preferably, the lock override means is adapted to be mounted to the lock support member in use so as to be fixed relatively to the support member, the lock override means having a housing, and a support element mounted for reciprocal movement in the housing and connected to the lock member support.

In one particularly convenient arrangement, we provide in combination a lock system in accordance with the first aspect of the present invention; a support member to which the lock is mounted; and a cover member mounted to the support member to prevent unauthorised access to the lock, the cover member being releasable from the support member only when the lock is operated by the second control system.

This arrangement assists in maintaining security of the lock. In one example, the lock may partially protrude through the cover member to prevent dissassembly of the cover from the support member and may be retracted under control of the second control system.

The first control system preferably includes processing means to enable a valid code to be set up and then to compare subsequent codes which are entered with the valid code and actuate, if appropriate, the lock.

Preferably, the second control system comprises processing means to enable a valid override code to be set up and then to compare subsequent codes which are entered with the valid override code and to actuate the lock, if appropriate. It is particularly convenient, if the second control system enables the override code to be changed.

Typically, the first and second control systems will have substantially the same construction. This leads to cheaper construction and ease of use.

It will be appreciated that with the systems according to the invention, a mechanical key is not required to enable the lock to be overriden. Instead, basic lock operation and the override feature are both achieved electronically leading to increased security. Furthermore, in the preferred arrangements, it is necessary to enter a particular override code into the second control system to override the lock and this cannot be derived easily by an unauthorised user of the second control system.

BRIEF DESCRIPTION OF THE DRAWINGS

An example of a lock system according to the invention will now be described with reference to the accompanying drawings, in which.

DETAILED DESCRIPTION OF EMBODIMENT

Figure 1:
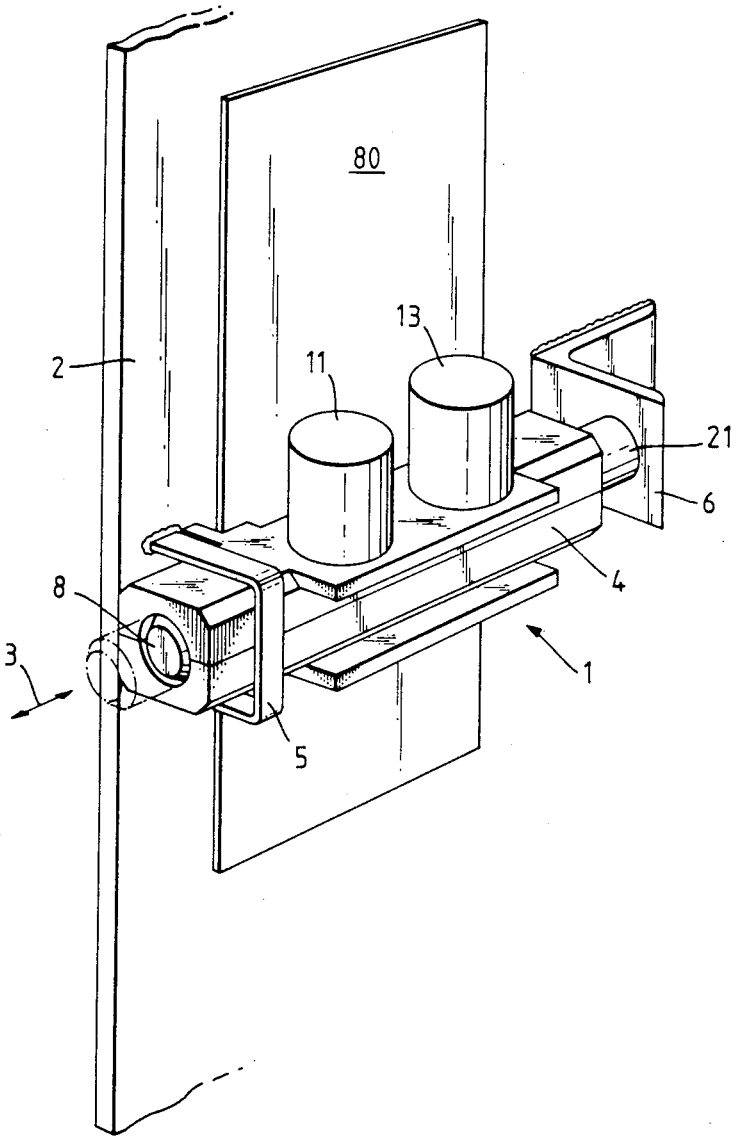
FIG. 1 perspective view of the lock system.

FIGS. 1 to 4 illustrate a lock 1 mounted to a door 2 of a safe. The lock 1 comprises a housing 4 slidably mounted to the door by brackets 5, 6 secured to the door, for movement in the directions indicated by an arrow 3. The housing 4 has a cylindrical internal bore 7 in which is received a cylindrical locking member 8. The locking member has an internally screw threaded bore 9 at its inner end which receives a lead screw 10 rotatably mounted in the housing 4. Rotation of the lead screw 10 causes the locking member 8 to move linearly within the bore 7 of the housing 4 between a locked position shown in dashed lines in FIG. 1 in which a leading end of the locking member 8 extends through an aperture (not shown) in a wall of the safe and an unlocked position, illustrated by solid lines in FIGS. 1 and 2 in which the locking member 8 is retracted into the bore 7 out of the aperture. In this position, the door 2 can be swung on hinges (not shown) from its closed position to an open position enabling access to the safe.

The locking member 8 is actuated by an electric motor 11 which is controlled to rotate via a worm gear (not shown) a helical gear 12 non-rotatably connected to the lead screw 10.

The motor 11 and an identical motor 13 are mounted on the housing 4. A lock override system 15 is mounted within a housing portion 16 of the housing 4, the portion 16 having an internal bore 17. A lead screw 18 is mounted in the housing 16 and extends into the bore 17. One end of the lead screw 18 has a helical gear 19 mounted non-rotatably to it which is coupled with a worm gear 14 rotatably driven by the motor 13. The other end of the lead screw 18 is received in an internally screw threaded bore 20 of a cylindrical guide member 21 non-rotatably but slidably mounted within the bore 17. The other end of the guide member 21 is anchored to the door 2 by the bracket 6. The guide member 21 is fixed against rotation or linear movement relatively to the bracket 6.

Actuation of the motor 13 causes rotation of the worm gear 14 and thus rotation of the lead screw 18. If the motor 13 is actuated with the lock 1 in the position shown in FIG. 1, this will cause the lead screw 18 to telescope into the bore 20 of the guide member 21 and thus carry the housing portion 16 and hence the lock 1 to the right as shown in FIG. 1 relative to the door 2. This motion will withdraw the lock member 8 from the aperture in the safe wall thus unlocking the door.

It will be seen therefore that under normal operation, the locking member 8 can be actuated simply by suitably operating the motor 11 to cause movement of the locking member 8 relative to the housing 4. However, in certain circumstances, to be described below, the locking member 8 can also be actuated by causing bodily movement of the lock 1 relative to the door 2 under the control of the motor 13.

Figure 5:
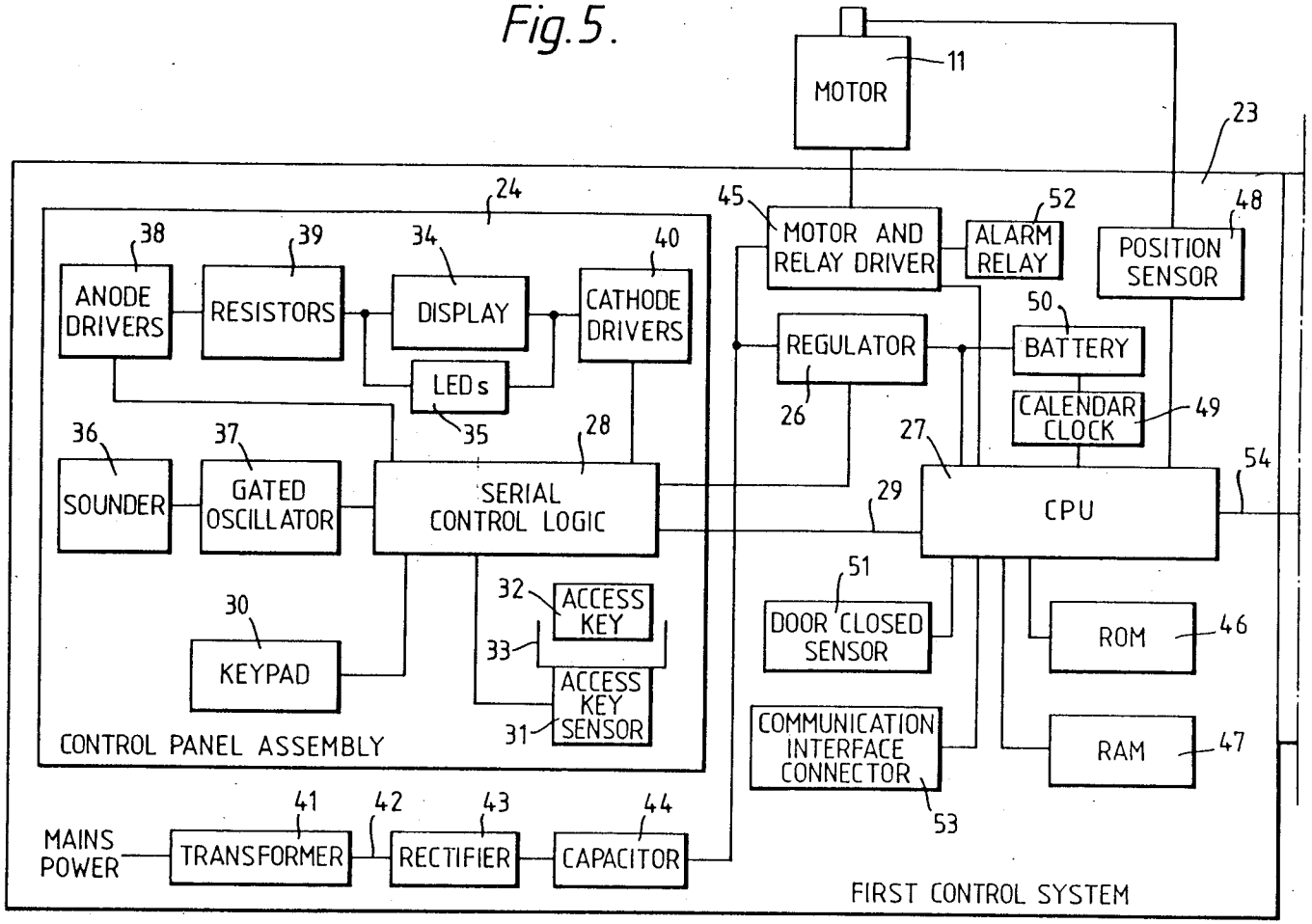
FIG. 5 is a block circuit diagram of the lock control system.
Figure 5:
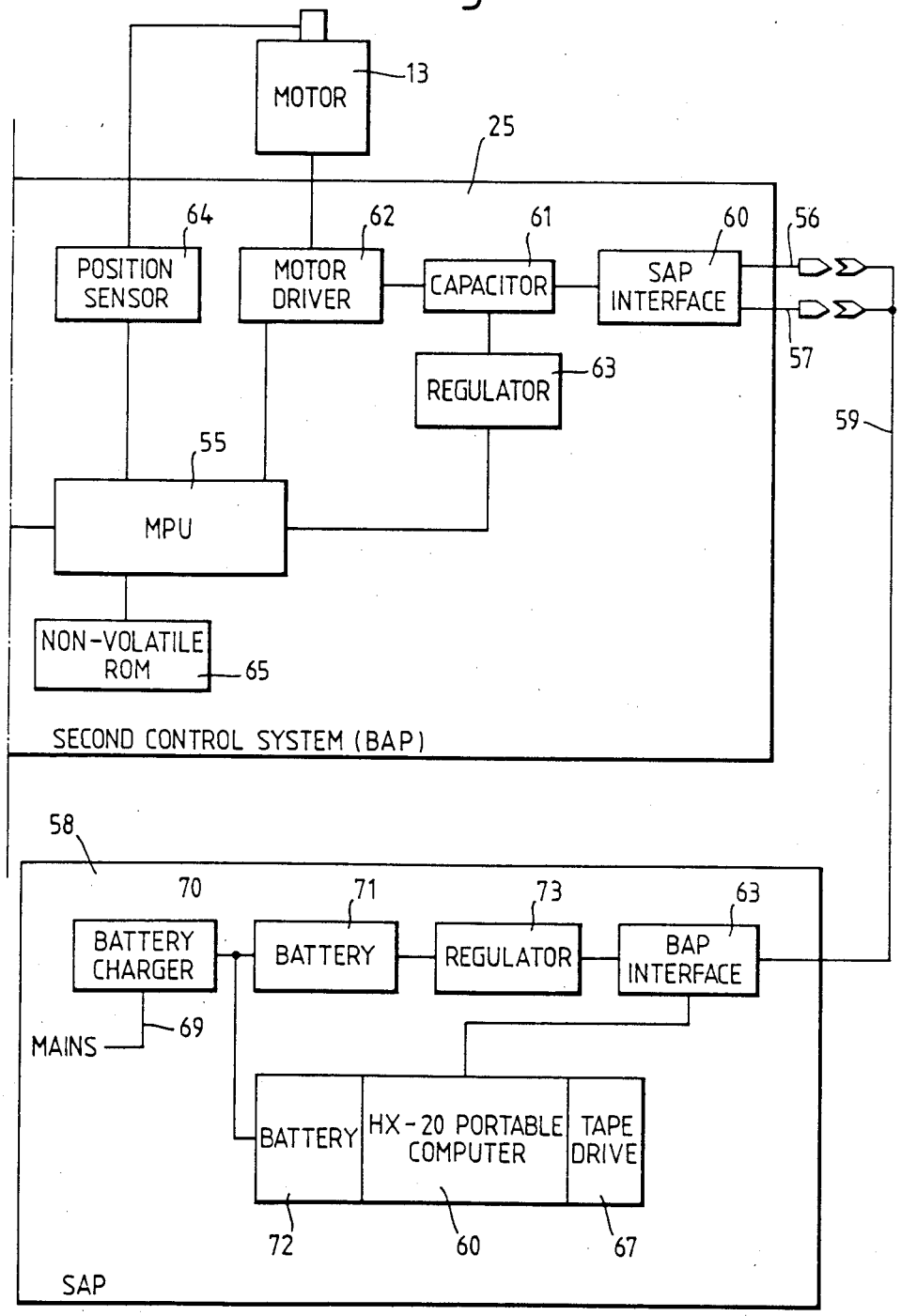

FIG. 5 illustrates in schematic form the control system. The control system comprises a first control system 23 which includes a control panel assembly 24 mounted to the outside surface of the door 2 and a second control system 25. The control panel assembly 24 is thus accessible to the operator and provides the means by which the operator activates the primary control system 23.

The control panel assembly 24 is powered from the voltage regulator 26 in the first control system 23 and is controlled by the microprocessor (CPU) 27 in the first control system 23. The CPU 27 is linked to the serial control logic 28 within the control panel assembly 24 via a two wire serial interface 29. The serial control logic 28 provides the means by which the CPU 27 can sense if any of the keys which comprise the keypad 30 are depressed and the output of the access key sensor 31. The access key sensor 31 senses if the access key 32 is present in the access key receptacle 33 of the control panel assembly 24.

The CPU 27 is able to provide visible output to the operator by means of the six digit seven segment LED display 34 and three discrete LED indicators 35 and audible output by means of the sounder 36. The sounder 36 is driven from a gated oscillator 37 which is controlled by the serial interface logic 28. The LED displays 34, 35 are driven in a multiplexed manner by the anode drivers 38 via the current limiting resistors 39 and by the cathode drivers 40 under the control of the CPU 27 by means of the serial interface logic 28.

Mounted on the lock 1 is a main control circuit board 80. The main control circuit board 80 contains the part of the first control system 23 not contained within the control panel assembly 24 and that part of the second control system 25 which is contained within the safe.

The first control system 23 is powered from a mains transformer 41 located within the body of the safe and connected by a low voltage cable 42 to the main control circuit board 80. The low voltage a.c. from the transformer 41 is rectified by the rectifier 43 and smoothed by the main reservoir capacitor 44.

The main reservoir capacitor 44 provides power to the motor and relay driver 45 and to the voltage regulator 26 which provides power to the other circuits which comprise the first control system 23.

The CPU 27 is connected to an optional external read only memory (ROM) 46 and random access memory (RAM) 47. The ROM 46 is used for program storage for the CPU 27 and the RAM 47 is used for supplementary data storage for the CPU 27.

The CPU 27 is able to instruct the motor and relay driver 45 to apply voltages to the motor 11 of such polarity to cause it to rotate in either a clockwise or an anticlockwise direction and thus to cause the locking member 8 to reciprocate between a locked position and an unlocked position.

Figure 2:
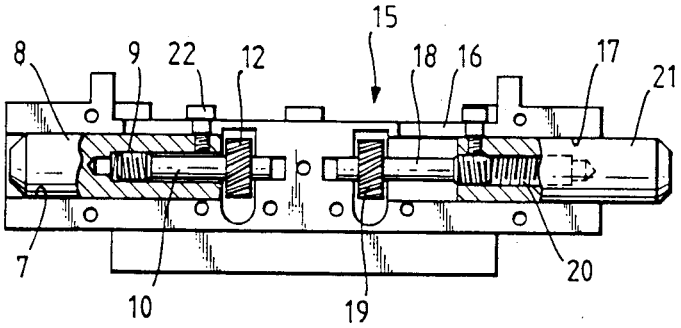
FIG. 2 is a longitudinal section through part of the lock system shown in FIG. 1.
Figure 3:
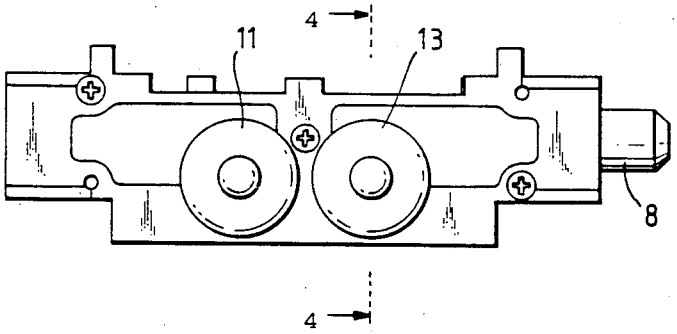
FIG. 3 is a plan of the lock system of FIG. 2.
Figure 4:
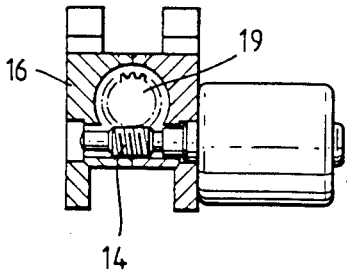
FIG. 4 is a section taken on the line 4—4 in FIG. 3.

The locking member 8 has an electrically insulating pin 22 radially inserted into it (FIG. 2). This pin 22 serves to prevent the locking member 8 from rotating within the cylindrical internal bore 7 of the housing 4. The tip of the pin 22 is metallised and serves to sense the position of the locking member 8.

As the locking member 8 moves within the housing 4 the pin 22 moves parallel to the main control circuit board 80. It is separated from it by a small ca. 0.25 mm air gap. The motion of the pin 22 induces changes in the capacitive coupling between sensing tracks on the main control circuit board 80. These changes are detected by the position sensing circuitry 48.

The CPU 27 causes the motor 11 to drive the locking member 8 towards the fully locked position until the position sensing circuitry 48 detects that the locking member 8 has reached the fully locked position. The CPU 27 drives the locking member 8 to the fully unlocked position in a similar manner.

The CPU 27 is connected to a calender clock circuit 49 which enables it to determine the time and date for such purposes as providing a time stamped event log for a security audit and to provide a clock display and an alarm clock function for operator usage.

In the event of a loss of main power to the transformer 41 the calender clock circuit 49 and the RAM within the CPU 27 are maintained from a rechargeable battery 50 which is trickle charged from the regulator 26 when mains power is available.

The door closed sensor 51 indicates to the CPU 27 when the safe door is closed. The CPU 27 drives the alarm relay 52 by means of the motor and relay driver 45. In the event of an alarm condition including the loss of mains power this relay 52 provides an alarm indication.

The CPU 27 can be linked to a central control and monitoring computer by means of the communications interface connector 53. The CPU 27 is linked via a two wire serial interface 54 to the microprocessor unit (MPU) 55 of the second control system 25.

On a separate part of the main control circuit board 80 is the main control circuitry of the second control system 25. The second control system 25 is connected to two domed bolts 56, 57 which protrude through the safe door 2 and are isolated from it by electrically insulating washers. These domed bolts 56, 57 are hidden from view by the control panel assembly 24 but are accessible from the outside of the safe.

The second control system 25 can be connected to a separate security access processor (SAP) 58 by means of the SAP connector and cable 59 which makes contact with the domed bolts 56, 57. The SAP 58 provides power to the second control system 25 through the domed bolts and the connector and cable 59. This power is fed via the SAP interface 60 to a reservoir capacitor 61 which provides power to the motor driver 62 and the voltage regulator 63. The voltage regulator 63 provides power to the other electronic circuits which comprise the second control system 25.

The MPU 55 drives the motor 13 by means of the motor driver 62 and the position sensing circuitry 64 in an identical manner to that used by the CPU 27 to drive the motor 11. The MPU 55 is connected to a non-volatile memory 65 which is used to store security code information.

Built into a briefcase the SAP 58 is based on an Epson HX-20 portable computer 66 with a built in microcassette drive 67. The SAP 58 is able to provide power to and communicate with the second control system 25 by means of the second control processor (BAP) interface circuitry 68 via the SAP connector and cable 59.

The SAP 58 is normally left connected to the mains supply 69 which provides power to the battery charger 70 which trickle charges the battery 71 and trickle charges the internal battery 72 in the HX-20 66. The battery 71 provides power to a regulator 73 which can be turned on and off under control of the HX20 66 to provide power to the second control system 25. The SAP 58 is normally operated with the mains supply 69 disconnected, the HX-20 66 runs from its internal battery 72 and the second control system 25 is powered from the battery 71.

Data is transmitted to the second control system 25 by momentarily interrupting the power feed to the SAP interface 60. The duration of this power feed interruption indicates the data bit transmitted. Data is transmitted to the SAP by the MPU 55 modulating the load presented to the BAP interface 68 by the SAP interface 60 during the momentary power interruptions. The reservoir capacitor 61 maintains power to the second control system 25 during the momentary interruptions to the power feed.

In normal operation a user will insert the access key 32 in the access key receptacle 33. This causes a "new code" LED to flash prompting the user to depress a "new code" key on the keypad 30 which will enable him to enter via the keypad a six digit code number which will become the new valid code number for operating the lock. The valid code is stored in the RAM within the CPU 27. After placing articles in the safe, the user closes the safe door and then depresses a "lock" key on the keypad 30. If the access key is present in the access key receptacle and a new code has been entered the CPU 27 which is controlled by a program stored in the ROM 46 actuates the motor 11 until the locking member 8 slides relatively to the housing 4 fully into the aperture in the safe wall.

When the user wishes to open the lock, he enters the code and the CPU 27 checks by comparison with the code stored in its RAM 47 that the entered code is valid. If it is, the CPU 27 actuates the motor 11 in the opposite direction until the locking member 8 is fully retracted.

If there is a failure in the first control system 23 or a power failure or the user forgets the valid code, it is not possible using the first control system to actuate the lock. To override the first control system 23, it is necessary to couple the security access processor 58 to the second control system 25. As previously mentioned, the SAP which forms the operator control panel for the second control system is typically carried by security personnel.

During a set-up procedure, a new valid override code is stored in the non-volatile RAM 65 of the control system 25 via the SAP 58. Subsequently, in order to override the lock 1, the SAP 58 is coupled via the SAP connector and cable 59 to the second control system 58. The MPU 55 then compares the entered code with the valid override code stored in the non-volatile RAM 65 and if they are identical, actuates the motor 13 until the lock 1 is fully withdrawn as described above. Subsequently, the SAP 58 will cause the motor 13 to operate in the opposite direction to cause the lock 1 to move relatively to the door 2 back to the position shown in FIG. 1.

It will be appreciated that the valid override code stored in the non-volatile RAM 65 of the second control system 25 can be changed leading to increased security.

We claim:

1. A lock system comprising:

a lock comprising a lock member support and a lock member mounted upon said lock member support, said lock being mounted to a lock support member;

a first electronic control system including a first electronically driven motor, and being operatively associated with the lock to unlock the lock when a valid code is entered into said first electronic control system, said lock member being movable relative to said lock member support between locked and unlocked positions upon actuation of said lock by said first electronic control system; and a second electronic control system including a second electronically driven motor and being independently connected to said lock and adapted to unlock said lock independently of said first electronic control system when an override code is entered into said second electronic control system, said lock member support being movable relative to said lock support member in response to actuation by said second electronic control system thereby to cause said lock member to move between its locked and unlocked positions.

2. A lock system according to claim 1, wherein said first electronic control system comprises an electronically reprogrammable member for storing said valid code.

3. A lock system according to claim 1, wherein said first electronic control system comprises first processing means for comparing an input code with a preset valid code and for operating said lock if said codes are the same.

4. A lock system according to claim 3, wherein said first electronic control system comprises an electronically reprogrammable memory for storing a valid code, said first processing means enabling a valid code to be stored in said memory.

5. A lock system according to claim 1, wherein said second electronic control system comprises an electronically reprogrammable member for storing a valid override code.

6. A lock system according to claim 1, wherein said second electronic control system comprises second processing means for comparing an input override code with a preset valid override code and for operating said lock if the codes are the same.

7. A lock system according to claim 6, wherein said second electronic control system comprises an electronically reprogrammable member for storing a valid override code, said second processing means enabling a valid override code to be stored in said memory.

8. A lock system according to claim 6, wherein said second electronic control system comprises means for inputting an override code, said inputting means being separable from said second process means.

* * * * *